US010973713B2

(12) United States Patent
Mussa-Ivaldi et al.

(10) Patent No.: US 10,973,713 B2
(45) Date of Patent: Apr. 13, 2021

(54) BODY SIGNAL CONTROL DEVICE AND RELATED METHODS

(71) Applicant: Rehabilitation Institute of Chicago, Chicago, IL (US)

(72) Inventors: Ferdinando A. Mussa-Ivaldi, Chicago, IL (US); Farnaz Abdollahi, Chicago, IL (US); Ali Farshchiansadegh, Chicago, IL (US); Maura Casadio, Chicago, IL (US); Mei-Hua Lee, Chicago, IL (US); Jessica Pedersen, Chicago, IL (US); Camilla Pierella, Chicago, IL (US); Assaf Pressman, Chicago, IL (US); Rajiv Ranganathan, Chicago, IL (US); Ismael Seanez, Chicago, IL (US); Elias Thorp, Chicago, IL (US)

(73) Assignee: Rehabilitation Institute of Chicago, Chicago, IL (US)

( * ) Notice: Subject to any disclaimer, the term of this patent is extended or adjusted under 35 U.S.C. 154(b) by 0 days.

(21) Appl. No.: 14/788,550

(22) Filed: Jun. 30, 2015

(65) Prior Publication Data

US 2015/0374563 A1 Dec. 31, 2015

Related U.S. Application Data

(60) Provisional application No. 62/019,162, filed on Jun. 30, 2014.

(51) Int. Cl.
*A61G 5/02* (2006.01)
*A61G 5/04* (2013.01)

(52) U.S. Cl.
CPC ..... *A61G 5/024* (2013.01); *A61G 5/04* (2013.01); *A61G 2203/10* (2013.01); *A61G 2203/18* (2013.01); *A61G 2203/30* (2013.01)

(58) Field of Classification Search
CPC ..... A61G 5/024; A61G 5/04; A61G 2203/30; A61G 2203/10; A61G 2203/18
See application file for complete search history.

(56) References Cited

U.S. PATENT DOCUMENTS

2003/0120183 A1* 6/2003 Simmons ..... G06F 3/011 600/595
2004/0216943 A1* 11/2004 Kwon ..... A61G 5/04 180/316

(Continued)

OTHER PUBLICATIONS

Casadio et al., Functional reorganization of upper-body movement after spinal cord injury, Exp Brain Res (2010) 207:233-247, DOI 10.1007/s00221-010-2427-8, 15 pages, Apr. 27, 2010.

(Continued)

*Primary Examiner* — Donald J Wallace
(74) *Attorney, Agent, or Firm* — Polsinelli PC; Timothy D. Fontes

(57) ABSTRACT

A method for controlling a powered wheelchair is disclosed. The method may comprise receiving first information from at least one user sensor coupled to a user of the wheelchair, said first information indicating the movement of the user; receiving second information from a reference sensor coupled to the wheelchair, said second information indicating the movement of the wheelchair; using the first information and the second information to prepare at least one instruction to move the wheelchair; and using the at least one instruction to move the wheelchair.

8 Claims, 9 Drawing Sheets

(56) References Cited

U.S. PATENT DOCUMENTS

| | | | | |
|---|---|---|---|---|
| 2007/0100508 | A1* | 5/2007 | Jeong | A61B 5/04888 701/1 |
| 2012/0136666 | A1* | 5/2012 | Corpier | H04L 12/2829 704/275 |
| 2012/0203487 | A1* | 8/2012 | Johnson et al. | G06F 19/00 702/104 |
| 2014/0156218 | A1* | 6/2014 | Kim | A61B 5/1114 702/150 |
| 2015/0195487 | A1* | 7/2015 | Liu | H04N 5/21 348/447 |

OTHER PUBLICATIONS

Mandel et al., Applying a 3DOF Orientation Tracker as a Human-Robot Interface for Autonomous Wheelchairs, Proceedings of the 2007 IEEE 10th International Conference on Rehabilitation Robotics, Jun. 12-15, Noordwijk, The Netherlands, 8 pages, 2007.

* cited by examiner

| Pin | Description |
|---|---|
| 1 | Empty |
| 2 | Translational Command |
| 3 | Ground |
| 4 | Rotational Command |
| 5 | Rotational Command |
| 6 | +2.5 Volts |
| 7 | Translational Command |
| 8 | Empty |

BODY SIGNAL CONTROL DEVICE AND RELATED METHODS

CROSS REFERENCE TO RELATED APPLICATION

This application is a non-provisional that claims benefit to U.S. Provisional Patent Application No. 62/019,162 filed on Jun. 30, 2014, which is herein incorporated by reference in its entirety.

STATEMENT OF FEDERAL SUPPORT

The invention was made with government support under contracts R21 HD053608 and R01 HD072080 awarded by the National Institutes of Health. The government has certain rights in the invention.

FIELD

This patent relates generally to the field of controllable machines, and in particular to systems and methods for controlling a controllable machine through the use of motion available to a user.

BACKGROUND

Machines can assist people who do not have the ability to walk. Certain machines, like manual wheelchairs, allow a person to move by pushing the wheels of the chair with their arms. Powered wheelchairs allow a person to move using a powered motor. A powered wheelchair may have a joystick, which directs the movement of the wheelchair. This allows the user to move the wheelchair without relying on the user's strength from his or her arms.

Some people are paralyzed, and have suffered the partial or total loss of use of all their limbs and torso. Some people with tetraplegia retain the limited use of the upper portion of their torso, but may not be able to use their arms to move a joystick of a powered wheelchair.

People with tetraplegia often retain some level of mobility of the upper body. A person's residual mobility may be used to enable control of computers, wheelchairs and other assistive devices. A control device is needed based on wearable sensors that adapt their functions to the users' abilities.

In the prior art, one system uses cameras to track infrared light sources to control a machine for a tetraplegic user. However, fluctuations in ambient and natural light compromise the functionality of the system. Another system is known in the prior art that relies on a single sensor placed on the head of the machine user. However, that system is compromised by head movements that affect the direction of gaze, does not rely on the residual mobility in the upper body of the machine user, which is usually more robust than the mobility of the head alone.

SUMMARY

A method for controlling a powered wheelchair is disclosed. The method may comprise receiving first information from at least one user sensor coupled to a user of the wheelchair, said first information indicating the movement of the user; receiving second information from a reference sensor coupled to the wheelchair, said second information indicating the movement of the wheelchair; using the first information and the second information to prepare at least one instruction to move the wheelchair; and using the at least one instruction to move the wheelchair.

A tangible storage medium storing a program having instructions for controlling a processor to control a powered wheelchair is also disclosed, the instructions comprising receiving first information from at least one user sensor coupled to a user of the wheelchair, said first information indicating the movement of the user; receiving second information from a reference sensor coupled to the wheelchair, said second information indicating the movement of the wheelchair; using the first information and the second information to prepare at least one instruction to move the wheelchair; and using the instruction to cause the wheelchair to move.

DETAILED DESCRIPTION

This patent discloses a device that facilitates operation of a machine, such as a wheelchair, by a user. The user dons a wearable item. User sensors are attached to the wearable item. One reference sensor is attached to the machine. The user sensors and reference sensor measure motion. The sensors are connected to a computing device. The computing device uses data collected from the sensors to move the machine in a desired direction. Feedback provides the user with the state of each control command, as well as indicating the direction the machine is moving in response to information from the sensors. Examples of feedback include a monitor mounted to the machine, or feedback provided through a vibrating actuator on the user's sleeve. The above description is intended to be an illustrative guide to the reader, and should not be read to limit the scope of the claims.

Figure 1:
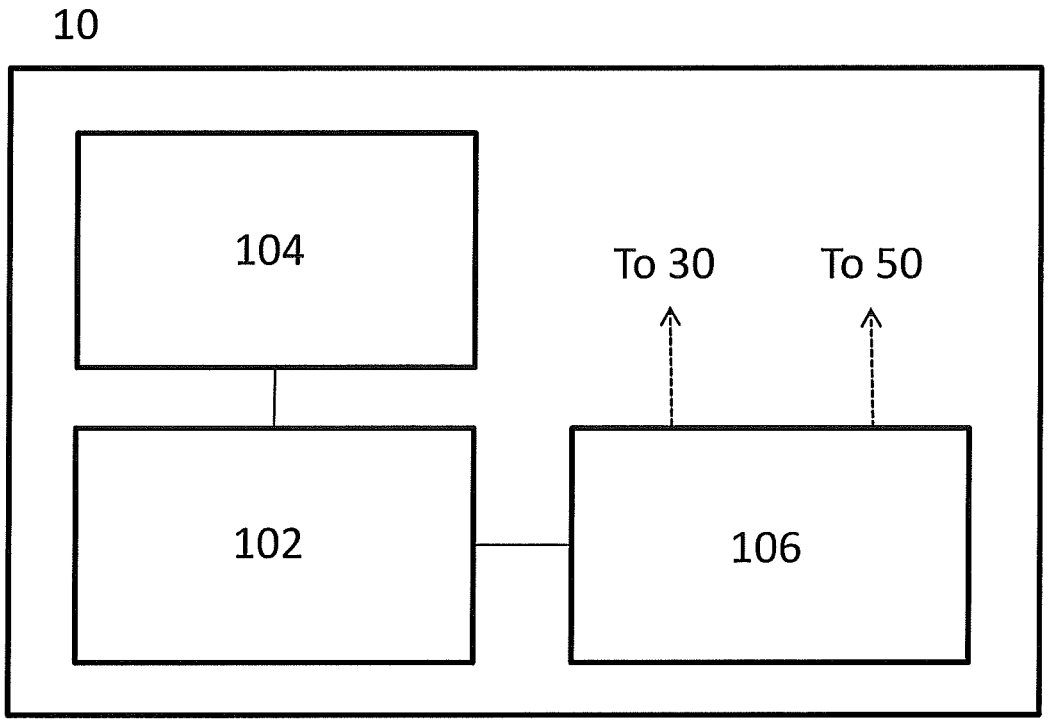
FIG. 1 is a block representation of one embodiment of a computing device 10 comprising controller 102, memory 104, and I/O interface 106

FIG. 1 presents a block representation of one embodiment of computing device 10. Computing device 10 may be a laptop, tablet, smartphone, personal digital assistant (PDA), mobile telephone, personal navigation device, or other similar device. As shown in the FIG. 1, computing device 10 may comprise a controller 102. Controller 102 may be composed of distinct, separate or different chips, integrated circuit packages, parts or components. Controller 102 may comprise one or more controllers, and/or other analog and/or digital circuit components configured to or programmed to operate as described herein with respect to the various embodiments. Controller 102 may be responsible for executing various control modules to provide computing and processing operations for control device 10. In various embodiments, the controller 102 may be implemented as a host central processing unit (CPU) using any suitable controller or an algorithm device, such as a general purpose controller.

Controller 102 may be configured to provide processing or computing resources to computing device 10. For example, controller 102 may be responsible for executing control module 110 described herein to cause movement of machine 30. Controller 102 may also be responsible for executing other control modules or other modules such as application programs.

Computing device 10 may comprise memory 104 coupled to the controller 102. In various embodiments, memory 104 may be configured to store one or more modules to be executed by the controller 102.

Although memory 104 is shown in FIG. 1 as being separate from the controller 102 for purposes of illustration, in various embodiments some portion or the entire memory 104 may be included on the same integrated circuit as the controller 102. Alternatively, some portion or the entire memory 104 may be disposed on an integrated circuit or other medium (e.g., hard disk drive) external to the integrated circuit of controller 102.

Computing device 10 may comprise an input/output (I/O) interface 106 coupled to the controller 102. The I/O interface 106 may comprise one or more I/O devices such as a serial connection port, an infrared port, integrated Bluetooth® wireless capability, and/or integrated 802.11x (WiFi) wireless capability, to enable wired (e.g., USB cable) and/or wireless connection between computing device 10 and sensors 50 or between computing device 10 and machine 30. In the exemplary embodiment, the I/O interface 106 may additionally comprise a PhidgetAnalog 4-Output (Phidgets Inc., Alberta, Canada). I/O interface 106 takes digital information from controller 102 and outputs it in the form of analog voltage signals. Output from I/O interface 106 may be used to control machine 30.

Figure 2:
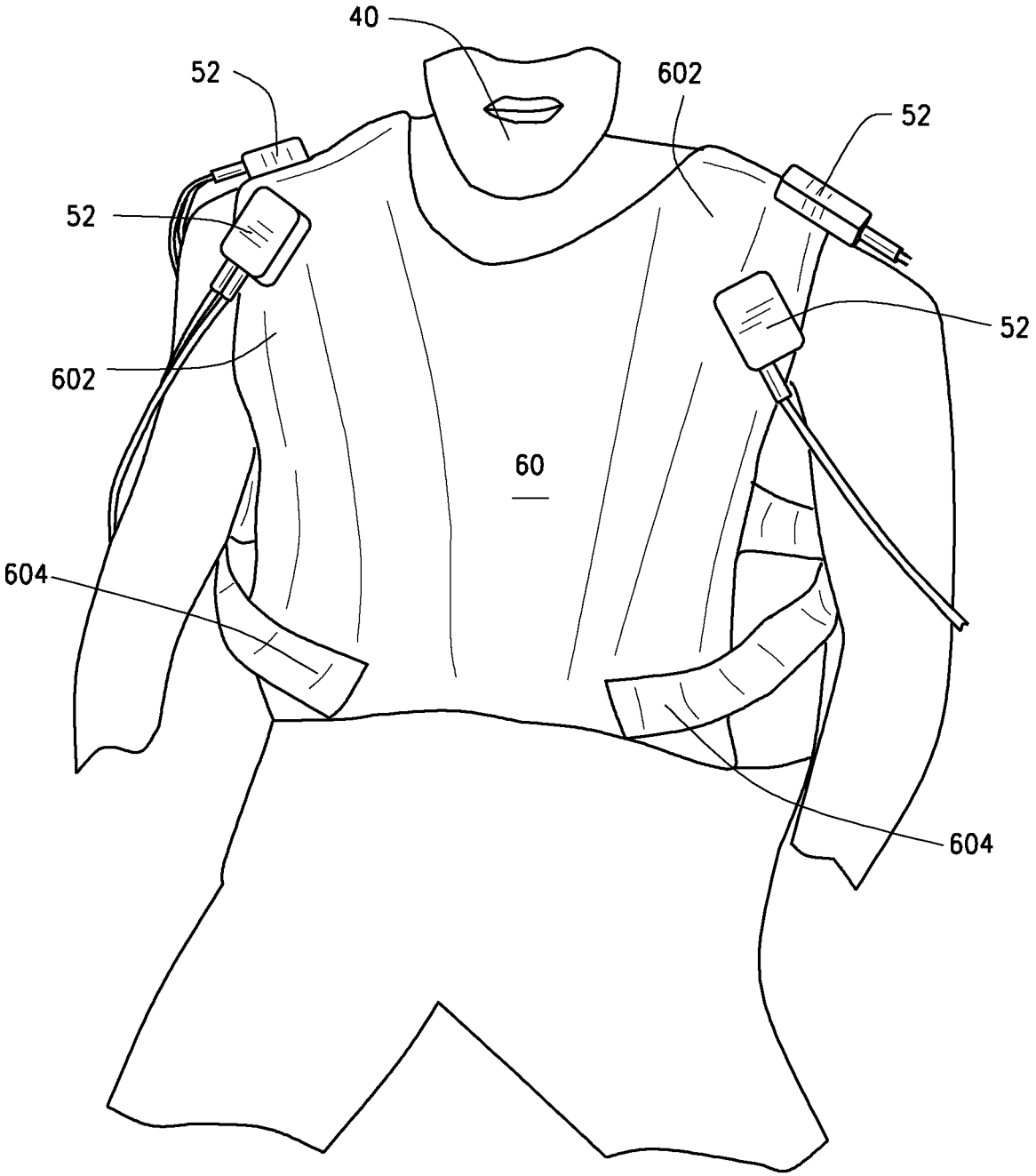
FIG. 2 shows one embodiment of a wearable item used to control machine 30.

The system described herein may further comprise a wearable item that assists the user in controlling the machine 30. In one embodiment, wearable item may take the form of a vest 60 shown at FIG. 2. Vest 60 has an opening at the top for the user to slip his or her head through. Velcro strips 602 are attached to vest 60 and may run down the length of each shoulder of the user. Velcro strips 602 are used to couple user sensors 52 to the user. In the embodiment shown at FIG. 2, vest 60 further comprises Velcro tabs 604 that mesh to securely fit vest 60 around the user, which limits the movements of user sensors 52 due to a poor fit of vest 60 on the user. In this embodiment, the lack of belt buckles or other protruding connectors or items allows the user to rest on the vest 60 for extended periods of time without experiencing discomfort or developing pressure sores.

Figure 3:
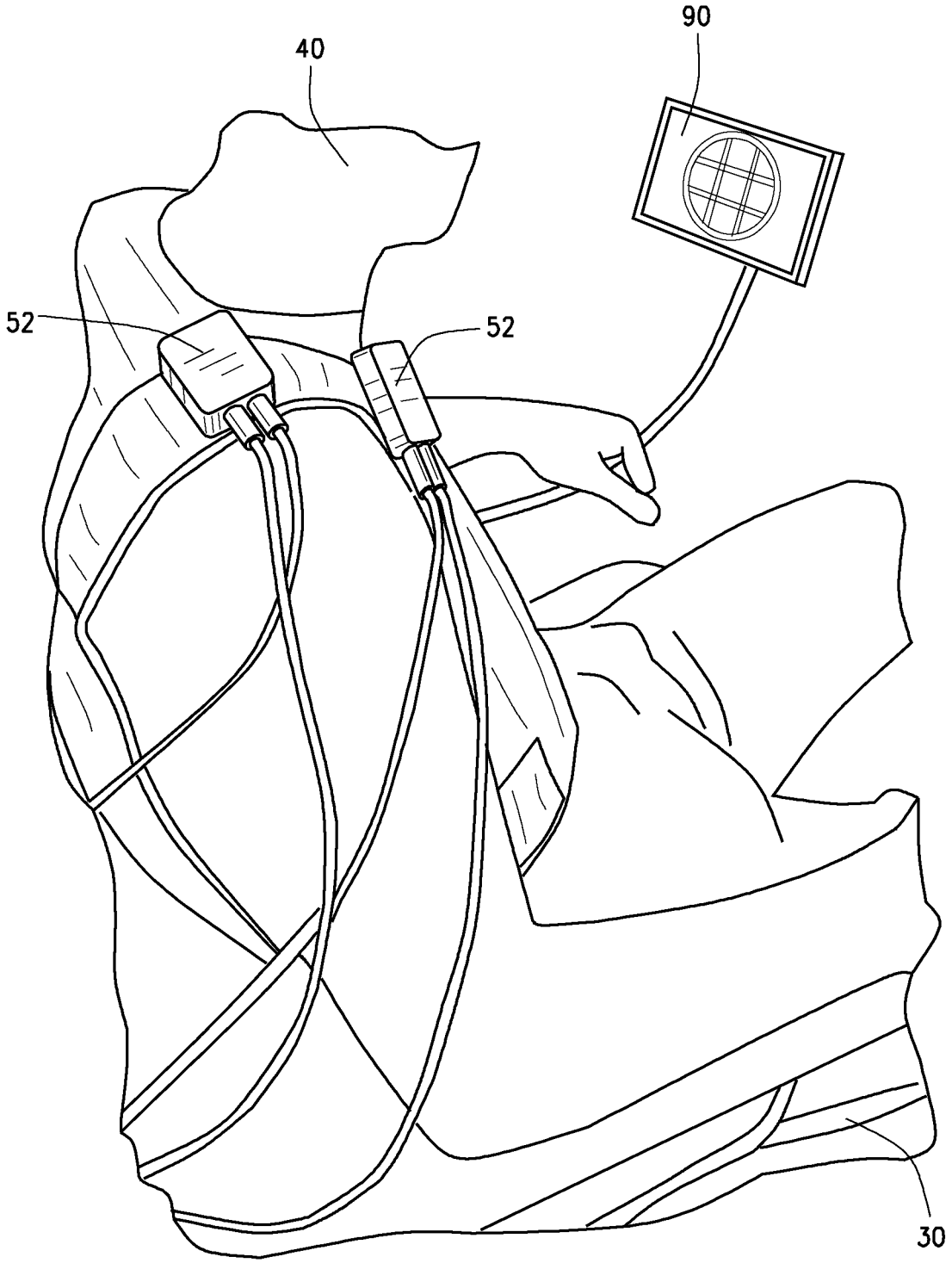
FIG. 3 shows one placement of sensors 52 in relation to user 40, and also shows one embodiment of monitor 90.

In embodiments of the system described herein, control commands 25 used for moving machine 30 are defined by body movements of the user 40. In one embodiment, user sensors 52 comprise inertial measurement units (IMUs) (sold under the name XTi, from Xsens (Culver City, Calif.)) placed in front and behind each shoulder of user 40 as shown in FIG. 3. Alternately, a user sensor 52 could be placed adjacent to the upper arm of user 40. User sensors 52 measure orientation using, for example, tri-axis accelerometers and gyroscopes. In one embodiment, user sensors 52 are used to measure changes in shoulder motion. When user 40 moves his or her shoulders, user sensors 52 move in a corresponding fashion. In one embodiment, each user sensor 52 measures the roll and pitch associated with movement of user 40's shoulders. Each user sensor 52 may be placed in any orientation except a vertical orientation, to avoid singularity of Euler representation of the orientation of the user sensor 52. The placement of each user sensor 52 may be adjusted initially by a clinician to optimally measure the roll or pitch or any other representation of the orientation.

Figure 4:
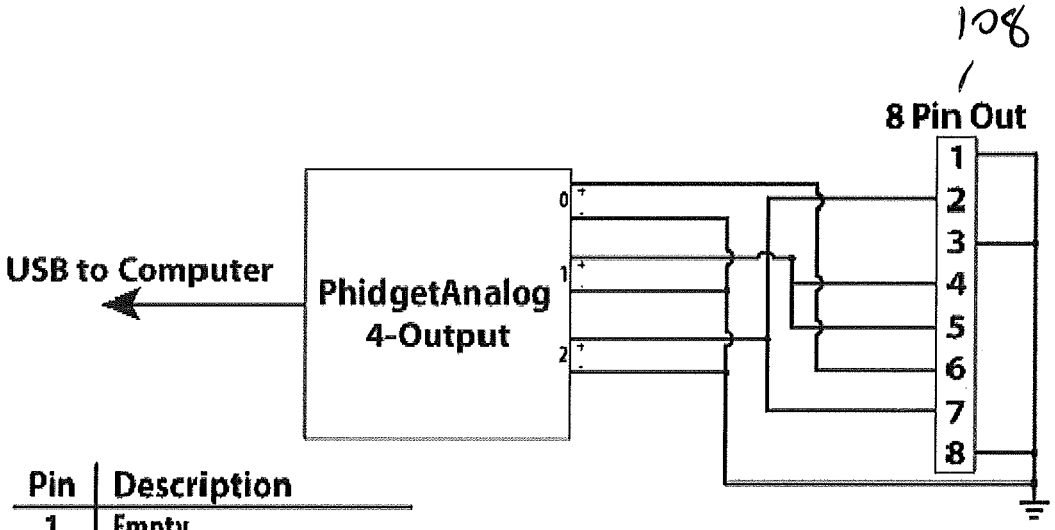
FIG. 4 shows a diagram of one aspect of an embodiment of I/O interface 106.

User 40 may be tetraplegic or have a similar condition that prevents him or her from using a standard I/O interface 106 such as a joystick to control machine 30. In one embodiment, I/O interface 106 is used to convert information from user sensors 52 into control commands 25 sent to computing device 10 causing machine 30 to move, such that a joystick is not needed. FIG. 4 shows a simplified diagram of one embodiment of I/O interface 106. I/O interface 106 may communicate with computing device 10 via USB, and be wired to an 8-pin header 108 to interface with machine 30. The description of each of the eight pins in header 108 is provided in the table accompanying FIG. 4.

Control module 110 may comprise a set of instructions that may be executed on controller 102 to cause machine 30 to move. In one embodiment, control module 110 makes use of the greatest ranges of motion available to user 40. For instance, in case of arm paralysis due to a stroke, user 40 is unable to make a particular motion, control module 110 will not use that motion to control machine 30. In one embodiment, the control module 110 utilizes a control space with eight dimensions, with each dimension representing either roll or pitch changes, from four user sensors 52, due to user 40 movements over time.

Figure 5:
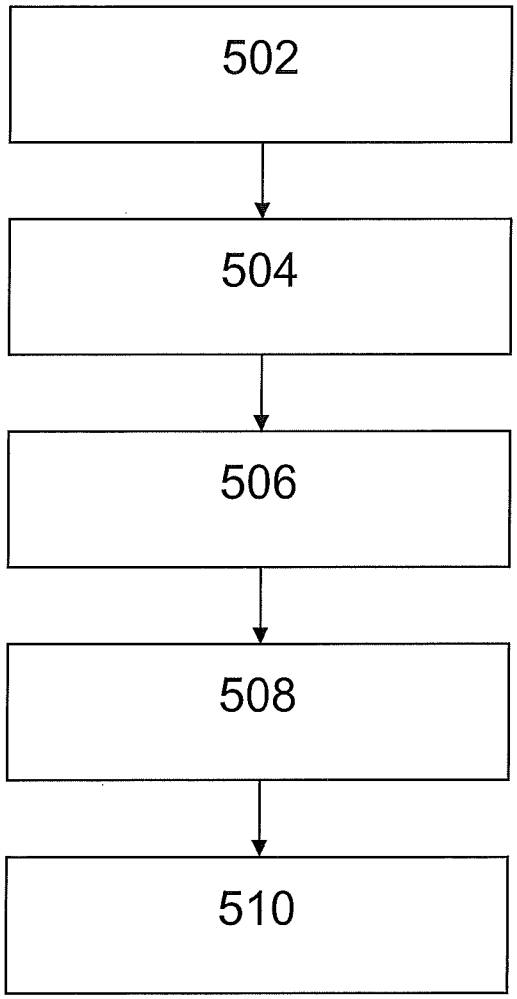
FIG. 5 shows a flowchart that reflects steps taken by control module 110 during training phase 500.

FIG. 5 is a flowchart reflecting the training steps that may be taken by control module 110 in training phase 500. The steps identified in FIG. 5 may reflect, for instance, the steps control module 110 takes to train itself to allow a user 40 to control the machine 30.

The steps in FIG. 5 reflect a training phase that is used to decrease the dimensionality of the control space. In 502, user 40 dons the vest 60 having user sensors 52. In 504, the computing device 10 is turned on and set to record training information by opening the software application and pressing a record button. In 506, user 40 performs a sequence of random shoulder motions, known herein as a "training dance." User 40 is instructed to move their shoulders and/or upper arms in as many varied positions as possible. In 508, as user 40 performs the training dance, control module 110 records roll and pitch values from the user sensors 52 and reference sensors 54. User 40 may repeat the training dance as needed to tailor control module 110 to the range of motions available to user 40.

In 510, when the user has completed the training dance, control module 110 prepares a weighing matrix WM that weighs the values of the instantaneous position information (discussed in more detail below). In one embodiment, WM is prepared with a statistical technique known in the art as Principal Component Analysis (PCA), using the information collected during training phase 500 from user sensors 52. This transformation is defined in such a way that the first principal component accounts for as much of the variability in the information received from each measure (such as roll or pitch) from each user sensor 52, and each succeeding component in turn has the highest variance possible under the constraint that it be orthogonal to (i.e., uncorrelated with) the preceding principal components. Control module 110 performs orthogonal transformation to convert the set of information collected from user sensors 52 during the training phase 500 into weighing matrix WM. In one embodiment, WM consists of a 2×8 matrix, where each 1×8 vector in WM represents one of two principal components: a first component to control the translational movement of machine 30 and a second component to control the rotational movement of machine 30. Table A reflects possible WM values for one user 40 of the system. It should be understood that other users 40 will have different ranges of movement, and so their WM values would likely differ from those set forth in Table A.

TABLE A

| | |
|---|---|
| 42.8475 | 1.4445 |
| 37.0614 | 55.5421 |
| −48.6089 | 53.9579 |
| −6.1819 | −88.4512 |
| −56.1509 | 1.5782 |
| 54.3959 | −58.7452 |
| 40.0270 | 66.6236 |
| −51.6489 | −11.0950 |

In other embodiments, WM may be more generally represented as an m×n matrix, where m is the number of desired principal components and n is the number of inputs from user sensors 52. In other embodiments, WM may be more generally represented as an m×n matrix, where m is number of control signals 25 sent to machine 30 and n is the number of inputs from user sensors 52. In other embodiments, additional principal components could be used to control machine 30 in supplementary modes, for example, to have machine 30 take a different action (such as a mouse click). In one embodiment, WM may be altered to encourage user 40 to make movements that may have some rehabilitative benefits. For example, if user 40 has a motor disorder that impairs one side of the body more than the other, the specific components of WM can be altered so as to encourage the user 40 to use the weaker side of their body more when controlling machine 30. This embodiment serves the dual purposes of controlling machine 30 while also providing some rehabilitative benefits for user 40.

Figure 6:
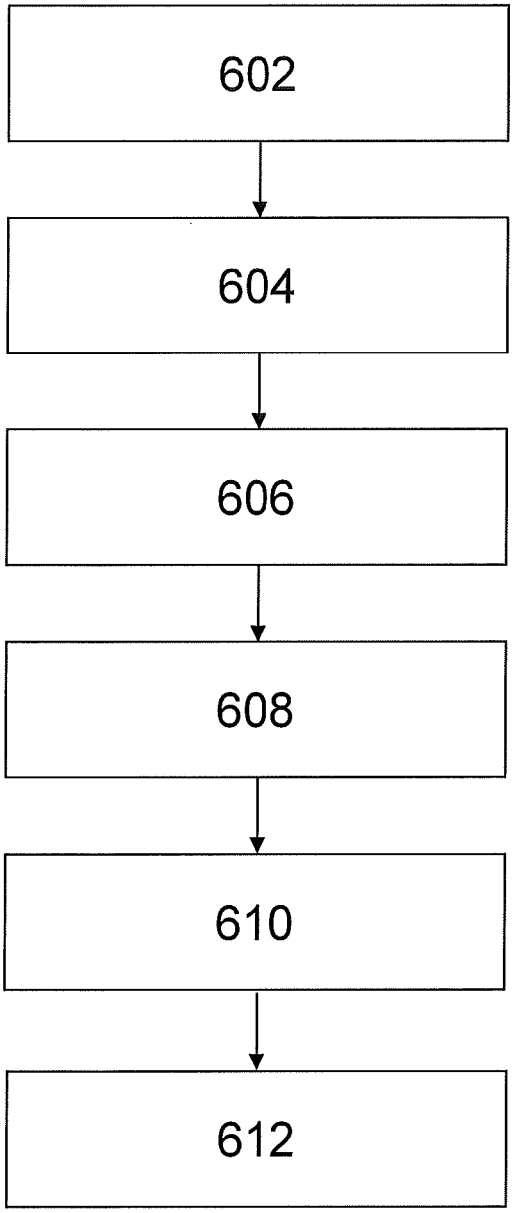
FIG. 6 shows a flowchart that reflects steps taken by control module 110 during operation of machine 30.

FIG. 6 is a flowchart that reflects the operation steps in operation phase 600 taken by control module 110 when the user 40 is controlling machine 30.

In 602, control device 10 is turned on and control module 110 is executed. In one embodiment, control module 110 is executed through Matlab. In 604, user sensors 52 send information regarding roll and pitch measures (or other appropriate measures) to control device 10 for receipt by control module 110. Also in 604, reference sensors 54 also send information regarding roll and pitch measures (or other appropriate measures) to control device 10 for receipt by control module 110. In 606, control module 110 prepares an unadjusted instantaneous position matrix uIM. In one embodiment, uIM is an 8×1 vector including roll values and pitch values from each of the four user sensors 52. In other embodiments, uIM may be more generally represented as an m×1 matrix, where m is the number of measures received from user sensors 52. In 608, control module 110 prepares a machine position matrix mIM from the values of measures sent by reference sensors 54. In 610, having mIM and uIM, control module 110 prepares an instantaneous position matrix IM, which is the user 40 movements, represented in the inertial frame of the machine 30. In 612, control module 110 determines position matrix PM by multiplying WM by IM. In one embodiment, PM is a 2×1 matrix.

Control module 110 uses PM to determine the appropriate control commands 25 to move machine 30. PM is multiplied by a scalar value to normalize it against the appropriate commands to send to machine 30.

In one embodiment, computing device 10 is coupled to a visual display, such as monitor 90. In one embodiment, monitor 90 is a 7-inch computer monitor mounted to machine 30. An embodiment of monitor 90 is shown at FIG. 3. Monitor 90 provides visual feedback to user 40 to indicate how control module 110 is translating the movement of user 40 into movement of machine 30. Monitor 90 may display a cursor 95 that reflects the current state of control commands 25. In one embodiment, the position of cursor 95 along the x-coordinate represents the magnitude of the rotational command 25*a* being sent to machine 30, and the position of cursor 95 along the y-coordinate represents the magnitude of the translational command 25*b* being sent to machine 30. To reinforce the learning of the control of the cursor 95, user 40 has the ability to disconnect the computing device 10 from the machine 30 and play video games using the monitor 90. In another embodiment, computing device 10 is coupled to a tactile display, such as an array of vibrating actuators 92. The vibrating actuators 92 give tactile feedback of how the movements of, user 40 are translated to the movement of machine 30 by control module 110. The vibrating actuators 92 may translate either the state of the control commands 25 or the speed and direction of machine 30 through changing amplitudes or frequencies of vibrational stimulation. The vibrating actuators 92 may provide feedback to user 40 that requires less attention than a visual display such as monitor 90.

Figure 7:
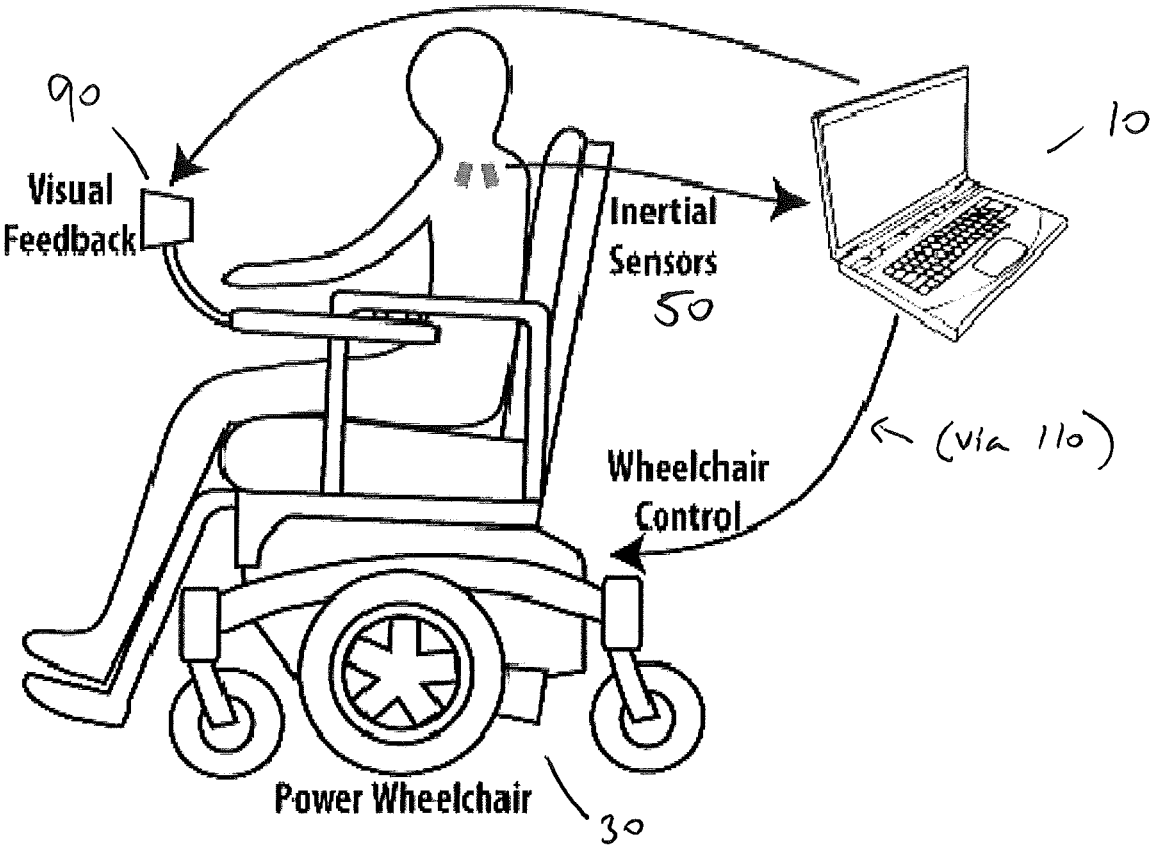
FIG. 7 shows one embodiment of the setup of machine 30 in relation to computing device 10, sensors 50, and monitor 90.

Machine 30 may be operated using control commands 25. In one embodiment, control commands 25 comprise rotational command 25*a* and translational command 25*b*. In one embodiment using control module 110, user 40 can manipulate the orientation of his or her shoulders to adjust rotational command 25*a* and translational command 25*b* independently. FIG. 7 shows one embodiment of the setup of machine 30 and control module 110. Information from inertial sensors 50 (comprising user sensor 52 and reference sensors 54) are sent to computing device 10 (comprising control module 110), which are used to control machine 30 (in this embodiment, a power wheelchair). Computing device 10 further provides visual feedback to monitor 90.

In one embodiment, the neutral position of control module 110 represents the position that causes the machine 30 to remain stationary. The neutral position of control module 110 is taken to be the mean posture during the training dance 506 during training phase 500. At this position, in the current embodiment, the rotational command 25*a* and the translational command 25*b* are held at 2.5 volts. In other embodiments, the control commands 25 are held at a voltage that for which the machine 30 remains stationary. Shoulder movements away from this mean posture, as measured by user sensors 52, cause control module 110 to change PM. Changes to PM are translated to changes in the voltages sent by the I/O interface 106 to machine 30. This causes machine 30 to move in a desired trajectory, defined by the movements of user 40.

In another embodiment the neutral position of I/O interface 106 represents the position that causes machine 30 to remain stationary. The neutral position of I/O interface 106 is taken to be the mean posture during the training phase 70, and is mapped to the center of the monitor 90. At this position, rotational command 25*a* and translational command 25*b* are held at 2.5 volts. Shoulder movements away from the mean posture cause machine 30 to move in a direction defined by that movement. In one embodiment, movements that cause the control commands 25 to change from the neutral position cause machine 30 to move forward or turn left. Opposite movements cause machine 30 to move backwards or right. To remove the effect of small involuntary body movements, for example breathing, a dead zone was enforced that spanned roughly 15% of the maximum possible movement along each direction. In other words, for each control command 25 if command signal 25 was within 15% of the maximal movement from the resting posture, command signal 25 would be held at 2.5 volts causing machine 30 to remain stationary. Implementing a dead zone also allows the user 40 to execute translation-only or rotation-only movements. Therefore, the user has the possibility to stop more easily correct erroneous movements while the cursor is still located in the dead zone. The remaining portions of the movements were linearly mapped to the output voltages as can be seen in FIG. 8.

Driving Control. In one embodiment, the control commands 25 used for moving machine 30 are defined by body movements. User sensors 52 that measure orientation using tri-axis accelerometers and gyroscopes are placed on the shoulders of user 40. User sensors 52 are used to measure changes in shoulder motion, for example, changes in the roll and pitch of each of the user sensors 52. In other embodiments, sensors may be other body parts. For instance, if a user 40 has substantial upper arm mobility, the sensors 52 may be places on the upper arm.

In one embodiment, machine 30 may be a motorized wheelchair known as the Quantum Q6 Edge (Pride Mobility Products, Exeter, Pa.). However, it should be understood that the use of this particular embodiment was chosen merely for convenience, and a broad range of other machines could be used in its place in accordance with the systems and methods described in our patent. The two control commands 25 needed to move machine 30 are analog voltages, which range from 1.1 to 3.9 volts shown in FIG. 8. At 1.1 volts, machine 30 drives backwards at the maximum velocity or turns right with the maximum angular velocity (depending on whether the voltage is a translational command 25*b* or rotational command 25*a*. At 3.9 volts, machine 30 drives forward or turns left at the maximum speed. At 2.5 volts, machine 30 remains stationary. The magnitude of the voltage defines the speed with which machine 30 moves.

Figure 8:
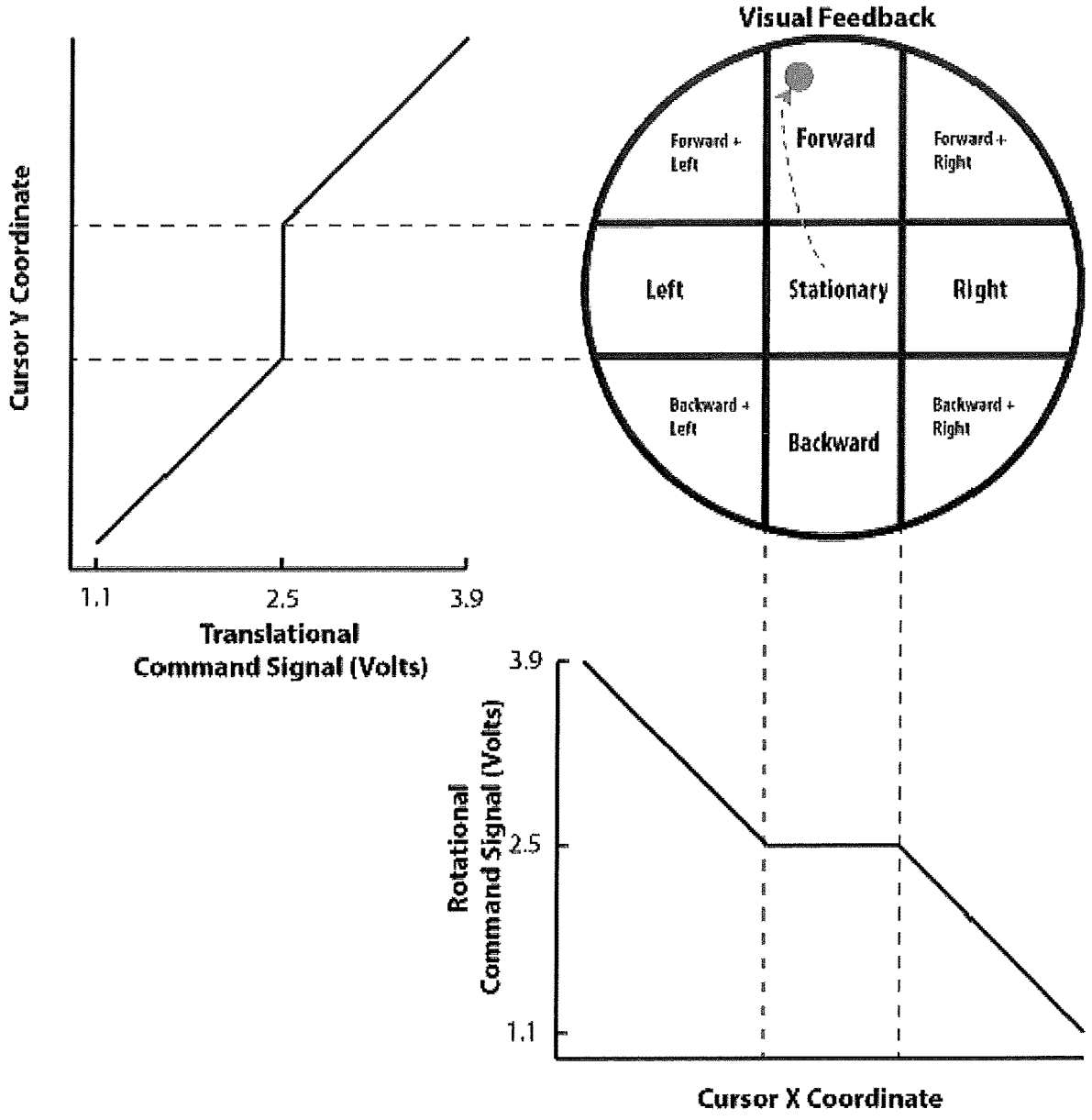
FIG. 8 is an illustration showing how translational and rotational command signals are mapped to visual feedback on monitor 90.

The charts and diagram shown in FIG. 8 reflect how translational and rotational command signals are mapped to visual feedback on monitor 90. The top right shows monitor 90 where cursor 95 indicates the current state of the two control command signals 25 (reflected by the two plots). The dashed line shown in the diagram titled "Visual Feedback" in FIG. 8 shows a potential path of cursor 95 from the mean posture. The two plots show how the cursor 95 coordinates reflect both the rotational command 25*a* (x-axis) and translational command 25*b* (y-axis) control commands 25.

In one embodiment, after processing by control module 110, the control commands 25 were generated using I/O interface 106. This small hardware device allows for output of four independent analog voltages that can range between −10 to 10 Volts. In one embodiment only the first three outputs were used. The first output (output 0) was set to be static at 2.45 Volts. This signal was required by machine 30 to ensure that the I/O interface 106 was functioning properly. Analog outputs 1 and 2 were set to rotational command 25*a* and translational command 25*b* respectively. Communication between I/O interface 106 and computing device 10 were accomplished using the MATLAB libraries provided by Phidget Inc. In one embodiment the pin-out of the analog device was wired to an 8 pin header shown in FIG. 4. This allowed for easy installation into the armrest where the current joystick is housed in the Quantum Q-Logic Controller. In another embodiment, the pin-out of the analog device was wired to a DB9 connector so it could easily interface with the enhanced display of the Quantum power wheelchair.

Wheelchair Movement Compensation. In one embodiment, machine 30 is able to measure changes in the roll and pitch of user 40 in a moving reference frame without the use of magnetometers, which do not allow the user to appropriately function when the user is in an elevator or in buildings with strong magnetic fields, or when sensors 50 are too close to the magnetic field created by the motors (not shown) of machine 30.

Figure 9:
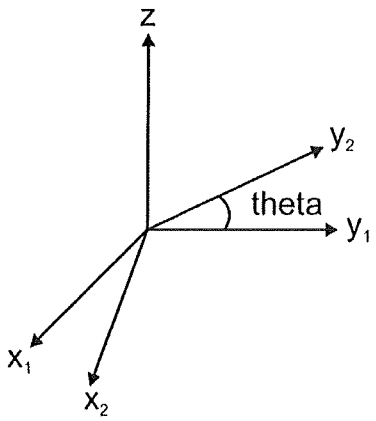
FIGS. 9 and 10 relate to exemplary rotation of reference frames of sensors 50.
Figure 10:
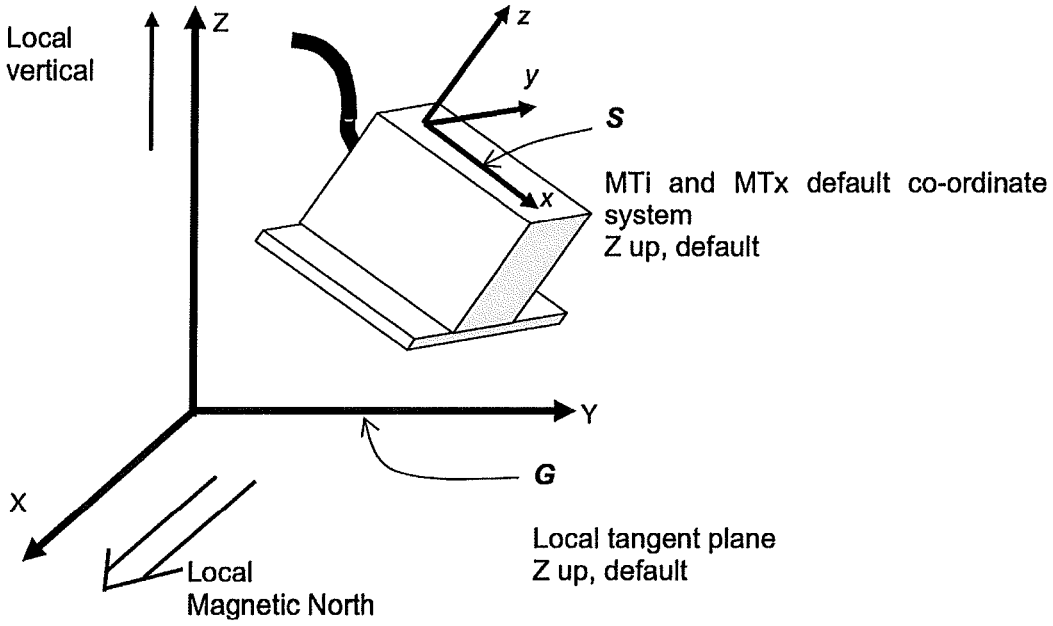

For our applications magnetometers, which act as a compass and measure the magnetic field of the Earth, are unreliable in many environments. Specifically, any environment that exhibits a changing magnetic field or large moving metallic objects will render the signals from the magnetometer unreliable. For this reason, the magnetometers were turned off. Because the sensors 50 are unable to detect magnetic north, the sensors 50 instead define an x-axis that is the projection of the sensor's 50 x-axis into the plane perpendicular to the global z-axis (direction of gravity). For this reason, the reference frames for sensors 50 are not perfectly aligned. However, because the vertical axis can be easily found by measuring gravity using the accelerometers, the reference frames of sensors 50 all share the same z-axis with different x- and y-axes. An example of two reference frames for two different sensors 50 is shown in FIGS. 9 and 10. In both sensors 50, the z-axis points in the vertical direction while the x- and y-axes of the two reference frames are misaligned by an angle A.

FIGS. 9 and 10 show an example rotation of reference frames. All sensors share a common z-axis which points in the opposite direction of gravity. The x- and y-axes of each sensor are the x- and y-axes in the sensor reference frame projected to the plane perpendicular to the common z-axis. The only rotational transformation between any two sensors is reflected by the angle θ. This misalignment means that if user sensors 52 are placed in different orientations on the body, any changes to the roll and pitch of machine 30 will be projected onto different reference frames and each sensor 50 will measure the change differently. For example, a change in the pitch of machine 30 (i.e. driving up a ramp) will likely be reflected as a change in both roll and pitch in sensors 50, where the general components of roll and pitch will be different for each sensor 50.

To account for this misalignment, control module 110 measures the angle θ. To find the θ between any two-sensor reference frames, control module 110 uses Equation (1), where the vectors $\vec{a}$ and $\vec{b}$ are vectors whose components are roll and pitch as measured by each of sensors 50. In one embodiment, vector $\vec{a}$ is from a user sensor 52 on the user 40's front left shoulder and vector $\vec{b}$ is from the reference sensor 54. The reference sensor 54 could be on machine 30, for example. (In this embodiment, for every sensor 50 there exists a vector containing the roll and pitch as measured by that sensor 50.)

i.

$$\theta = \operatorname{atan}\left[\frac{|\vec{a}\times\vec{b}|}{\vec{a}\cdot\vec{b}}\right] \tag{1}$$

Using θ, control module 110 constructs a rotation matrix $R_{12}$ using Equation (2) that may be used to rotate the angles as measured by a first sensor 50*a* into the reference frame of a second sensor 50*b*. Control module 110 then projects the measurements from a reference sensor 54 (which may be mounted to machine 30 and only measure angle changes that are a result of machine 30 motion) into the reference frame for each of the sensors 50. The signals will now be in the same reference frame, so control module 110 subtracts the rotated signal of the reference sensor 54 from the measurements of the other sensors 50 to remove components of machine's 30 motions from sensors 50.

ii.

$$R = \begin{bmatrix} \cos(\theta) & -\sin(\theta) \\ \sin(\theta) & \cos(\theta) \end{bmatrix} \quad (2)$$

Using the rotation matrix with respect to each user sensor 52, control module 110 projects the measurements from the reference sensor 54 into the frame of each of the user sensors 52. By subtracting the projected reference sensor 54 measurements from the measurements of the user sensor 52, control module 110 eliminates the effects of movements from machine 30 alone. Although the systems and methods described in this patent can be used by tetraplegic users to control a motorized wheelchair, it should be understood that other uses are readily available.

What is claimed is:

1. A method for controlling a powered wheelchair, the method comprising:

providing a control module executed by a computing device, and a plurality of sensors in operative communication with the control module, the plurality of sensors including one or more user sensors coupled to shoulders of a user, and a reference sensor coupled to a powered wheelchair;

training the control module to interpret an intended movement of the powered wheelchair by the user, by:

(i) generating training information by recording, by the plurality of sensors, a first plurality of measures corresponding to a sequence of predetermined self selected and self paced shoulder motions comfortable to the user as based on residual mobility available to the user, (ii) repeating step (i) to tailor the control module to a range of motion defined by the residual mobility of the user, and (iii) preparing, by the control module, a weighing matrix from the training information that defines one or more values uniquely corresponding to the range of motion defined by the residual mobility of the user;

generating an instantaneous position matrix from a second plurality of measures recorded by the plurality of sensors as the user executes a movement constrained by the residual mobility; and multiplying the weighing matrix by the instantaneous position matrix to derive a position matrix defining a control command from the user to move the powered wheelchair based on the movement of the user.

2. The method of claim 1, further comprising, by the control module, converting the training information to the weighing matrix using orthogonal transformation, the weighing matrix representing a first component to control a translational movement of the powered wheelchair and a second component to control a rotational movement of the powered wheelchair.

3. The method of claim 1, wherein the weighing matrix weighs values of an instantaneous position information using principal component analysis such that a first principal component accounts for as much variability in the training information from each signal of the one or more user sensors, and each succeeding component in turn has a highest variance possible under a constraint that it be orthogonal with preceding principal components.

4. The method of claim 3, wherein the control module utilizes principal components to control the powered wheelchair in a supplementary mode.

5. The method of claim 3, further comprising, by the control module, altering the weighing matrix to encourage the user to make movements for controlling the powered wheelchair to rehabilitate a predetermined body portion of the user.

6. The method of claim 1, further comprising:

accessing reference frames associated with the plurality of sensors, computing a rotation angle between any two of the reference frames using vectors a and b corresponding to roll and pitch respectively measured by the plurality of sensors, and using the rotation angle to construct a rotation matrix to project measurements from the reference sensor into the reference frames of the one or more user sensors to align the reference frames of the plurality of sensors.

7. A device for customized control of a powered wheelchair, comprising:

a plurality of sensors including a user sensor positioned along a shoulder of a user, and a reference sensor positioned along a powered wheelchair; and a computing device in operative communication with the plurality of sensors, the computing device executing a control module that adapts to a residual mobility of the user, such that the control module:

accesses training information associated with a first plurality of measures recorded by the plurality of sensors as the user conducts a sequence of predetermined self selected and self paced shoulder motions comfortable to the user as based on the residual mobility of the user, generates a weighing matrix from the training information that defines one or more values uniquely corresponding to a range of motion defined by the residual mobility of the user, accesses control information associated with a second plurality of measures recorded by the plurality of sensors as the user conducts a movement related to the sequence of predetermined self selected and self paced shoulder motions comfortable to the user as based on the residual mobility of the user; and applying the weighing matrix to the control information to determine a control command to move the powered wheelchair.

8. The device of claim 7, wherein the weighing matrix decreases dimensionality of a control space and adapts control of the powered wheelchair to the residual mobility of the user.

* * * * *